US009527114B2

(12) United States Patent
Helmlinger et al.

(10) Patent No.: US 9,527,114 B2
(45) Date of Patent: Dec. 27, 2016

(54) APPARATUS AND METHOD FOR OPENING AND SORTING ENVELOPES

(71) Applicant: Opex Corporation, Moorestown, NJ (US)

(72) Inventors: David R Helmlinger, Mount Laurel, NJ (US); Robert DeWitt, Marlton, NJ (US)

(73) Assignee: OPX CORPORATION, Moorestown, NJ (US)

( * ) Notice: Subject to any disclaimer, the term of this patent is extended or adjusted under 35 U.S.C. 154(b) by 0 days.

(21) Appl. No.: 14/583,886

(22) Filed: Dec. 29, 2014

(65) Prior Publication Data

US 2015/0114890 A1 Apr. 30, 2015

Related U.S. Application Data

(62) Division of application No. 13/446,726, filed on Apr. 13, 2012, now Pat. No. 8,919,570.

(60) Provisional application No. 61/475,118, filed on Apr. 13, 2011.

(51) Int. Cl.

| | |
|---|---|
| ***B43M 7/00*** | (2006.01) |
| ***B07C 5/02*** | (2006.01) |
| ***B07C 5/00*** | (2006.01) |
| ***B07C 5/04*** | (2006.01) |
| ***B26D 7/32*** | (2006.01) |

(52) U.S. Cl.

CPC . *B07C 5/02* (2013.01); *B07C 5/00* (2013.01); *B07C 5/04* (2013.01); *B26D 7/32* (2013.01); *B43M 7/00* (2013.01); *B43M 7/008* (2013.01); *Y10T 83/141* (2015.04); *Y10T 83/2024* (2015.04); *Y10T 83/2074* (2015.04); *Y10T 83/2085* (2015.04); *Y10T 83/2209* (2015.04); *Y10T 83/6489* (2015.04)

(58) Field of Classification Search

CPC ..... B07C 1/02; B07C 1/10; B07C 1/14; B07C 1/16; B07C 3/08; B43M 7/00; B43M 7/008; G06K 1/121; B26D 7/32; Y10T 83/2074; Y10T 83/2085; Y10T 83/2209; Y10T 83/6489

See application file for complete search history.

(56) References Cited

U.S. PATENT DOCUMENTS 3,915,089 A * 10/1975 Schubert ..... B07C 1/00 101/232
3,943,807 A 3/1976 Bingham et al.
4,576,287 A 3/1986 Bingham et al.
(Continued)

OTHER PUBLICATIONS

Omation—Model 106 Envelopener with Unique Milling Cutter, product brochure, published before Apr. 2012.

(Continued)

*Primary Examiner* — Joseph C Rodriguez
(74) *Attorney, Agent, or Firm* — Dann, Dorfman, Herrell and Skillman; Stephen Eland

(57) ABSTRACT

An apparatus is provided for processing mail by severing an edge of each envelope in a stack of mail. The apparatus includes an input bin for receiving a stack of mail. A feeder feeds the bottom envelope from the input bin to a transport that conveys the envelope along an envelope path. A cutter positioned along the envelope path severs one edge of the envelopes. A detector detects a characteristic of the envelope and a sorter sorts the envelope in response to the detected characteristic.

12 Claims, 5 Drawing Sheets

(56) References Cited

U.S. PATENT DOCUMENTS

| | | | | |
|---|---|---|---|---|
| 4,867,437 | A | 9/1989 | Wise | |
| 5,156,515 | A | 10/1992 | Charron et al. | |
| 5,238,123 | A * | 8/1993 | Tovini | B07C 1/10 209/556 |
| 5,443,253 | A | 8/1995 | Dale et al. | |
| 5,470,182 | A | 11/1995 | Krupotich et al. | |
| 5,649,628 | A * | 7/1997 | Stevens | B07C 1/00 209/534 |
| D422,874 | S | 4/2000 | Forbes | |
| 6,311,846 | B1 * | 11/2001 | Hayduchok | B07C 1/00 209/3.3 |
| 6,408,744 | B1 * | 6/2002 | Viennet | G07B 17/00508 101/91 |
| 6,547,078 | B1 | 4/2003 | Lile et al. | |
| D478,121 | S | 8/2003 | Forbes | |
| 6,612,211 | B1 | 9/2003 | Stigliano et al. | |
| 6,912,827 | B2 | 7/2005 | Forbes | |
| 6,915,909 | B2 * | 7/2005 | Pillard | B65H 29/16 209/586 |
| 7,424,436 | B2 * | 9/2008 | Katikaneni | G07B 17/00508 705/401 |
| 7,561,844 | B2 * | 7/2009 | Ishizuka | G03G 15/2064 399/407 |
| 8,283,588 | B2 * | 10/2012 | Norris | B07C 1/10 209/586 |
| 8,344,872 | B2 * | 1/2013 | Minckler | G07B 17/00661 340/501 |
| 8,507,821 | B2 * | 8/2013 | Varghese | B07C 3/14 209/584 |
| 8,919,570 | B2 * | 12/2014 | DeWitt | B07C 5/00 209/655 |
| 2002/0073052 | A1 * | 6/2002 | Katikaneni | G07B 17/00508 705/408 |
| 2007/0059069 | A1 | 3/2007 | Ishizuka | |

OTHER PUBLICATIONS

Omation—Model 202C Envelopener, product brochure, published before Apr. 2012.

Omation—Model 2000 Table Top Envelopener with Unique Milling Cutter, product brochure, published before Apr. 2012.

Omation—Model EV-2 Sorter/Verifier, product brochure, published before Apr. 2012.

International Search Report & Written Opinion issued in PCT/US12/33574 on Oct. 29, 2012.

* cited by examiner

APPARATUS AND METHOD FOR OPENING AND SORTING ENVELOPES

PRIORITY CLAIM

This application is a divisional application of U.S. patent application Ser. No. 13/446,726, filed Apr. 13, 2012. This application also claims priority to U.S. Provisional Patent Application No. 61/475,118, filed Apr. 13, 2011. The entire disclosure of each of the foregoing applications is hereby incorporated herein by reference.

FIELD OF THE INVENTION

The present invention relates to an apparatus for processing mail and, more specifically, to an apparatus for severing an edge of an envelope to facilitate removal of the contents from the envelope.

BACKGROUND OF THE INVENTION

Automated and semi-automated machines have been employed for processing mail. One such device is an envelope opener that is operable to sever an edge of each piece of mail being processed. A typical known envelope opener has an input bin for receiving a stack of mail, and a feeder for feeding the envelopes from the input bin to a conveyor that conveys the envelopes to a device that severs an edge of the envelopes.

Known envelope openers typically sever an edge of each envelope and then sort all of the envelopes to a single output area. It would be desirable to sort some of the pieces so that certain pieces can be separated from the mail. For instances, envelopes that are thick may indicate mail that requires special processing. Although large automated mail processing machines are operable to open and sort mail, such systems are too large and expensive for many applications. Accordingly, the known systems that have the capability of opening and sorting mail are inappropriate for many applications.

SUMMARY OF THE INVENTION

In light of the shortcomings of the existing devices, the present invention provides an envelope opening apparatus for efficiently processing mail. The apparatus includes an input bin for receiving a stack of envelopes. A feeder serially feeds the envelopes from the input bin to a transport which conveys the envelopes along an envelope path. A cutter positioned along the envelope path operates to sever one edge of each of the envelopes. While the cutter severs the edge, the system evaluates one or more characteristics of the envelope. A gate then directs the envelope to either a first area or a second area depending on the evaluated characteristic of the envelope.

According to another aspect, the present invention provides an apparatus for opening envelopes that includes an input bin for receiving a stack of envelopes, a cutter operable to sever an edge of the envelopes, and a cutter transport for conveying the envelopes from the input bin past the cutter. A sensor detects a characteristic of an envelope. A first sort conveyor is positioned underneath a portion of the cutter transport, and the first sort conveyor conveys cut envelopes from a drop area to a first output area. A second sort conveyor conveys cut envelopes to a second output area.

According to yet another aspect of the invention, the apparatus includes a gate moveable between a first position and a second position. The gate is controllable in response to a characteristic sensed by a sensor for each envelope. In the first position, the gate directs the envelope toward the second sort conveyor. In the second position, the envelope is directed to the drop area of the first conveyor.

According to a further aspect of the invention, a method is provided for processing envelopes. The method includes the step of conveying an envelope from a stack of envelopes. An edge of the envelope is cut as the envelope is being conveyed. A characteristic of the envelope is detected during the step of cutting the edge of the envelope. The envelope is then sorted based on the step of detecting a characteristic.

DESCRIPTION OF THE DRAWINGS

The foregoing summary as well as the following detailed description of the preferred embodiment of the present invention will be better understood when read in conjunction with the appended drawings, in which.

DETAILED DESCRIPTION OF THE PREFERRED EMBODIMENT

Figure 1:
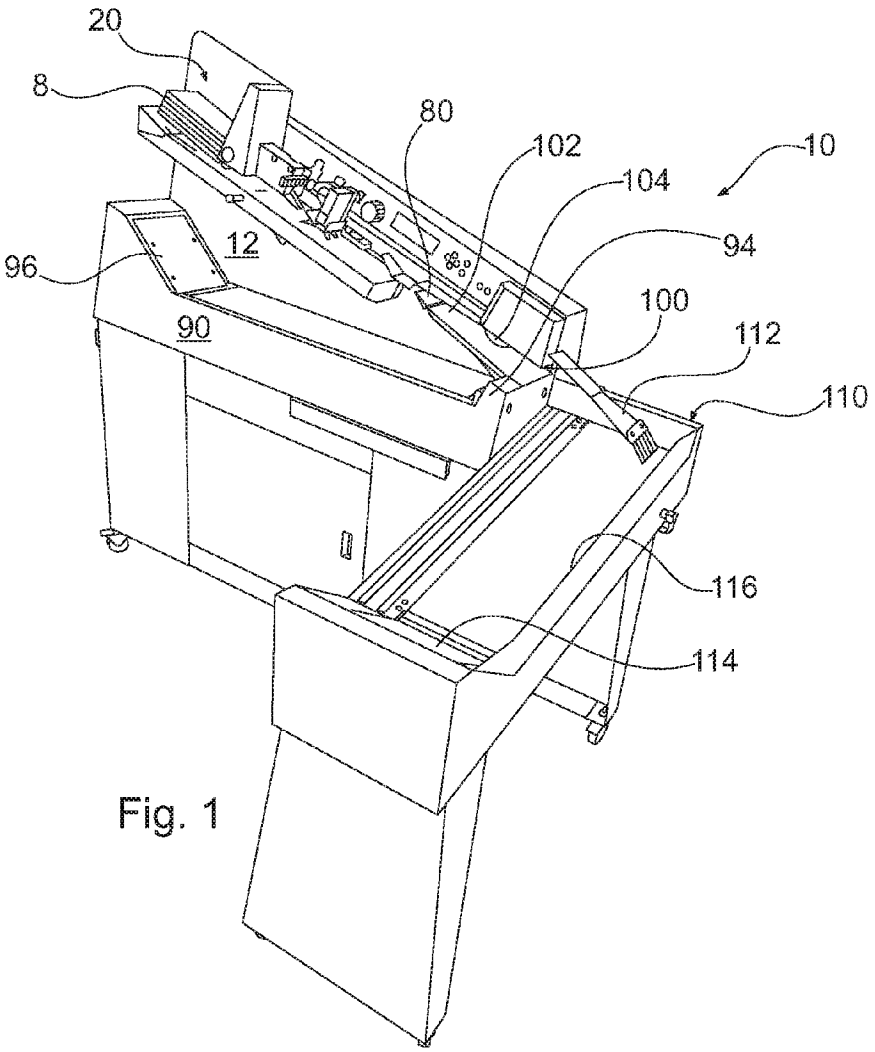
FIG. 1 is a perspective view of an apparatus for opening envelopes according to the present invention.
Figure 2:
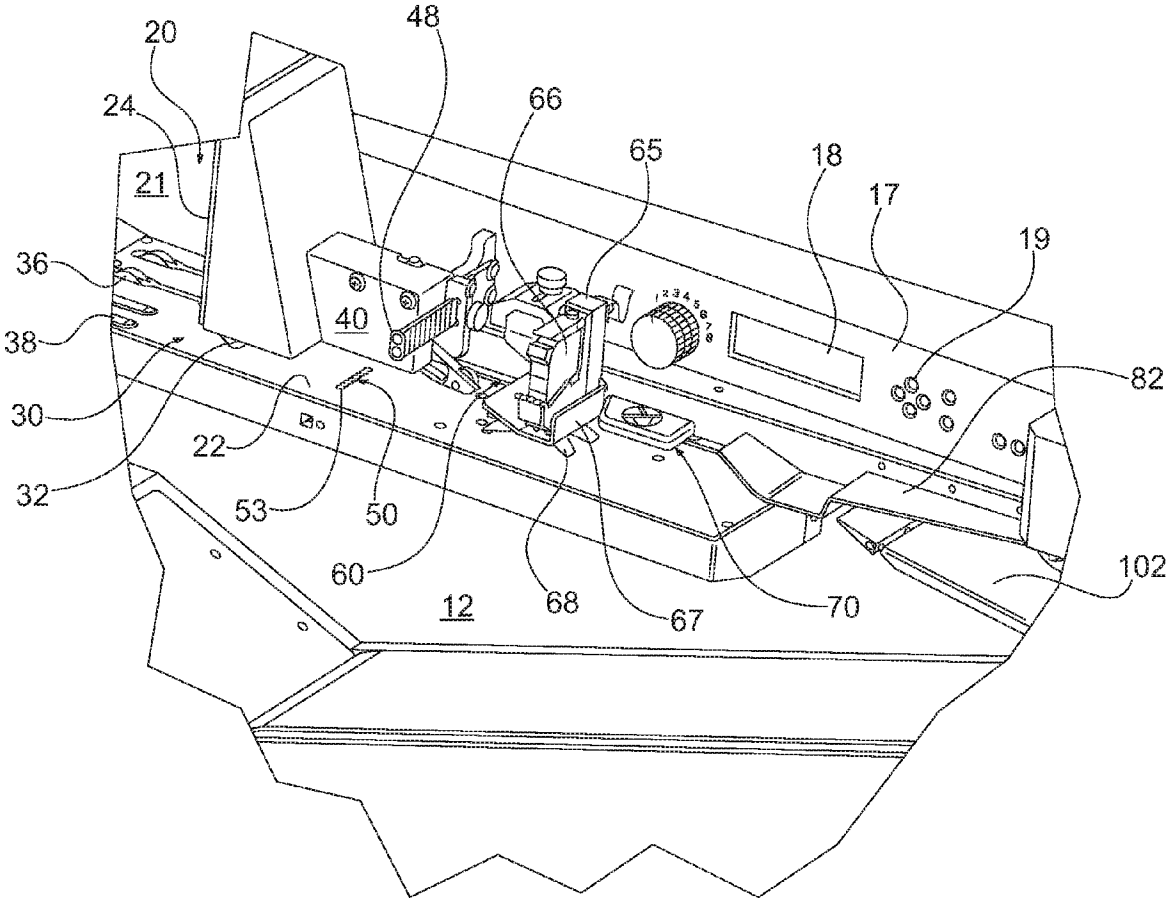
FIG. 2 is an enlarged fragmentary perspective view of the apparatus illustrated in FIG. 1.

Referring now to the drawings in general and to FIGS. 1 and 2 specifically, a device for opening envelopes is designated 10. The envelope opener 10 includes an input bin 20 for receiving a stack of unopened envelopes 6. A feeder 30 serially feeds the envelopes from the input bin 20 to an envelope transport 60, which conveys the envelopes along a path. A cutter assembly 70 positioned along the envelope path severs an edge of each envelope as the transport 60 conveys the envelopes. From the cutter, the envelope is conveyed to one of several discharge areas. A gate 80 directs the envelope to either a discharge slot 100 or to an output conveyor 90 that conveys the envelopes to a stacking area, where the envelopes are reoriented from a generally horizontal orientation to form a stack of opened envelopes 8 in an inclined orientation. The vertically oriented envelopes accumulate on the output conveyor in a horizontal stack until they are manually removed by an operator. The operation of the device is controlled by a control panel 17 having an LCD output screen 18 and a plurality of buttons 19 for manually inputting various operational parameters, such as the number of envelopes to be processed before pausing to allow the operator to remove the stack of opened envelopes 8.

The device 10 is operable to open envelopes of various sizes, including standard-size envelopes, oversized envelopes, commonly referred to as flats, and other large envelopes such as cardboard overnight shipment letter packs. The various envelope sizes need not be sorted by size prior to processing. Instead, a stack of envelopes of similar or varying envelope-size can be processed together. The stack of envelopes 8 is placed into the input bin 20 so that the envelopes form a vertical stack of horizontally disposed envelopes.

The device 10 includes a generally vertical back plate 12. Referring to FIG. 1, preferably, the back plate 12 is angled from front to back approximately 15° from vertical.

The input bin 20 includes a rear wall 21, a side wall 24 and a generally planar base plate 22 that also extends under the envelope transport 60. The rear wall of the input bin is parallel to and attached to the back plate 12 The base plate 22 is generally horizontal, projecting from the back plate substantially normal to the back plate, angling downwardly from left to right from the perspective of FIG. 2. Preferably, the stack of envelopes are edge justified along one of the edges of the stack and the justified edge of the stack is placed in the input bin 20 against the rear wall 21. In addition, the transport 60 is disposed at an angle toward the back plate 12, so that the transport justifies the envelopes against the back plate. In this way, the transport feeds the envelopes forwardly along the envelope path, and laterally toward the back plate 12.

In the present instance, the input bin 20 includes a pair of longitudinally elongated ribs 38 protruding upwardly from the base plate 22 adjacent the front edge of the base plate 22. Standard sized envelopes lie flat on the base plate 22 between the ribs 38 and the rear wall 21. The front edge of oversized mail engages the ribs 38 so that the front edge of an oversized envelope rests on the ribs, thereby further angling the oversized envelope toward the rear wall 21 to reduce the possibility of oversized envelopes falling forward out of the input bin.

Referring to FIGS. 1 and 2, the feeder 30 feeds the envelopes from the input bin 20 to the transport 60 one at a time. The feeder 30 includes a pair of feed belts 36 that protrude through the base plate 22 in the input bin 20, confronting the bottom envelope of the stack of envelopes. The side wall 24 of the input bin terminates above the base plate 22 forming a feed slot between the base plate and the bottom edge of the side wall.

Figure 3:
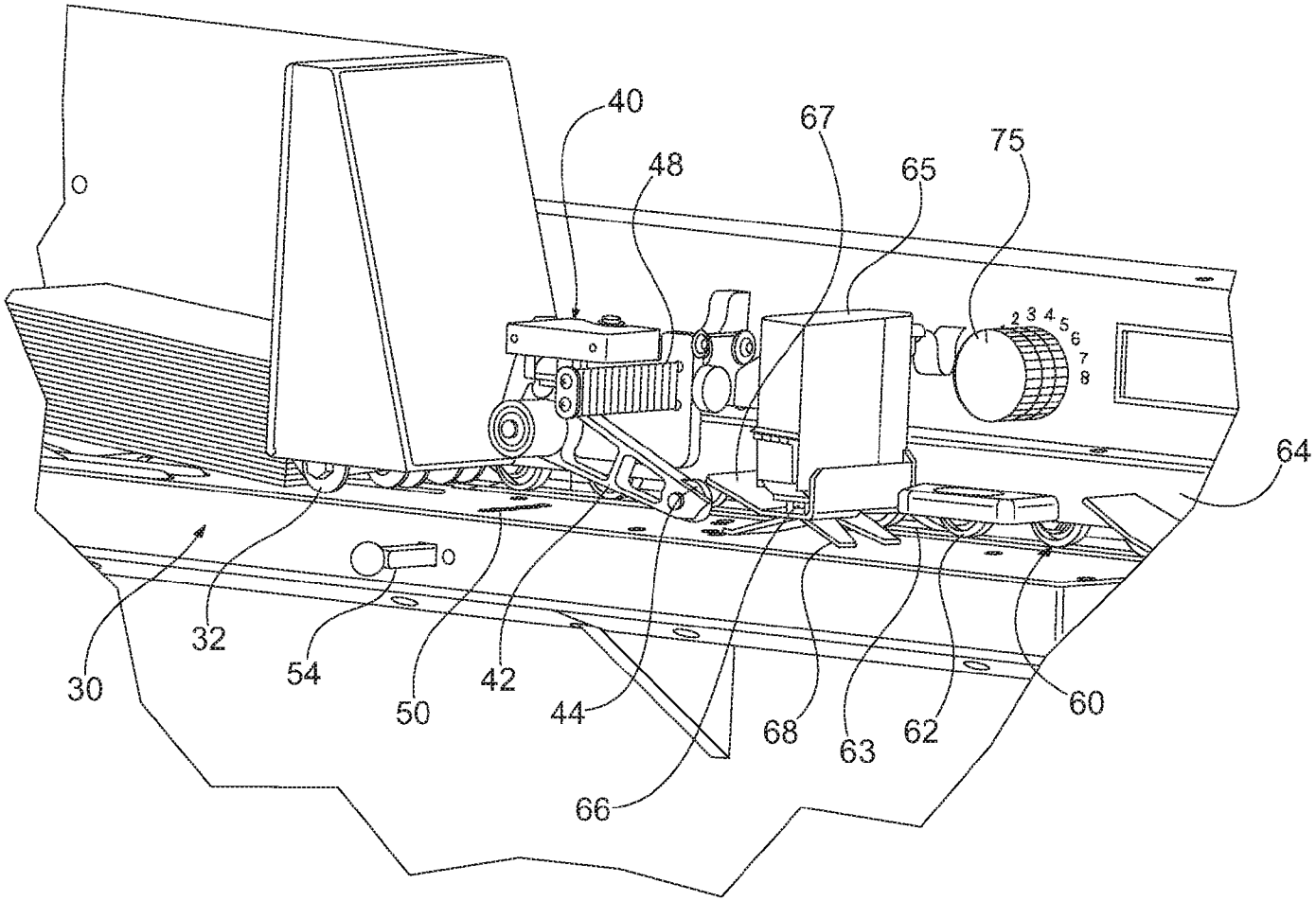
FIG. 3 is an enlarged fragmentary perspective view of the apparatus illustrated in FIG. 1.

Referring to FIGS. 2-3, the feeder 30 feeds the envelopes to the transport 60, which conveys the envelopes past a cutter assembly 70. The transport comprises a plurality of rollers 62 in an aligned row opposing a transport belt 63. The transport 60 conveys the envelopes between the transport belt 63 and the rollers 62. In this way, the transport 60 conveys the documents past the cutter assembly 70 with the envelopes in a generally horizontal orientation rather than a vertical or on-edge orientation. Specifically, the envelopes are face down so that the edges of the envelope are generally in a common horizontal plane rather than the upper edge being above the lower edge as in an on-edge orientation. However, in the present instance, the transport belt 63 is angled toward the back plate 12, similar to the feeder, so that the transport belt conveys the envelopes forwardly along the envelope path and laterally toward the back plate.

Each roller 62 of the transport is mounted on a pivotable arm positioned vertically above the transport belt 63 so that each roller can pivot toward or away from the transport belt depending on the thickness of the mail piece. Each roller arm is biased downwardly urging the corresponding roller 62 into contact with the transport belt 63. A cover 64 partially encloses the rollers to prevent the operator from inadvertently contacting the rollers 62 during operation of the device.

Figure 5:
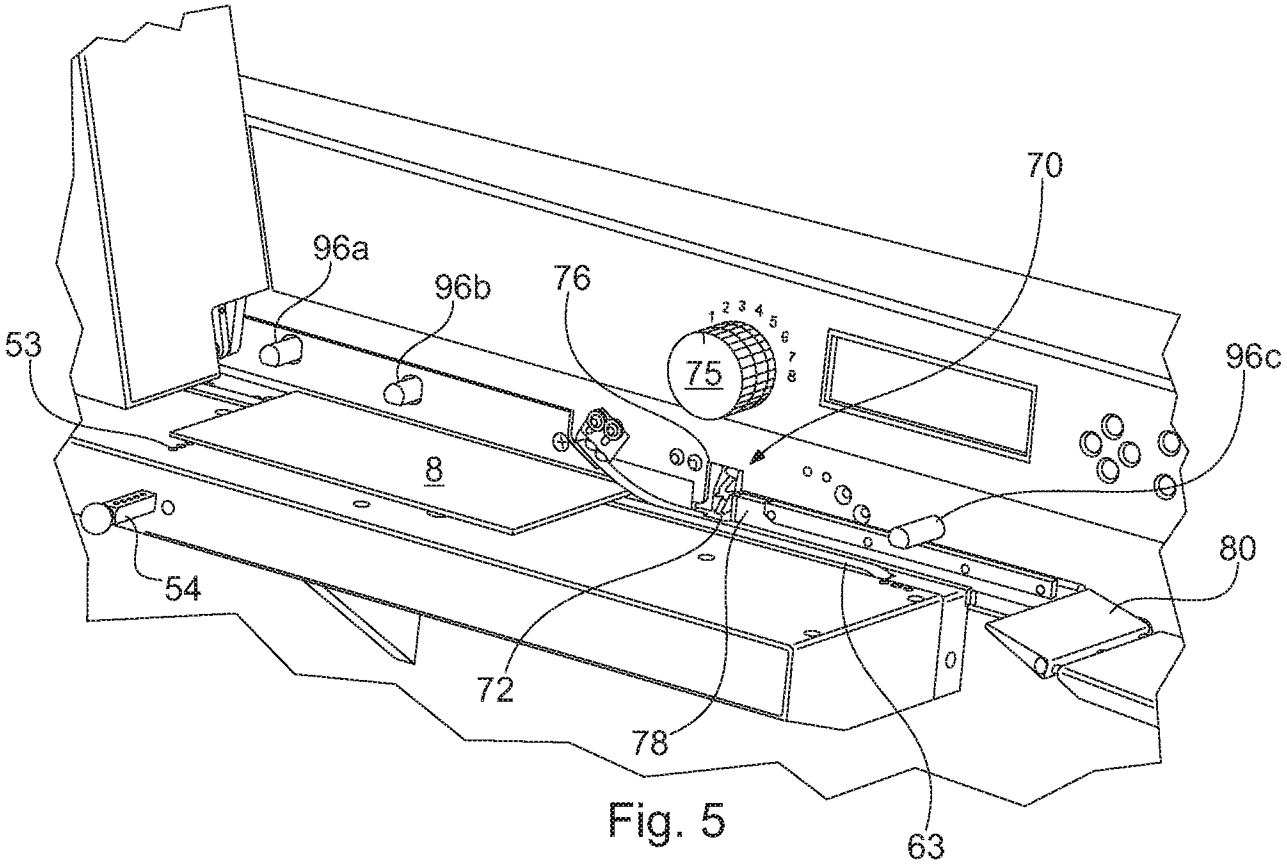
FIG. 5 is an enlarged fragmentary perspective broken away view, illustrating details of sensors of the apparatus illustrated in FIG. 1.

Referring now to FIGS. 2 & 5, the cutter assembly 70 is positioned along the path of the transport 60, and it includes a circular milling cutter 72 housed within a housing located behind the back plate 12. The milling cutter 72 rotates about an axis that is generally parallel to the direction of travel of the envelopes as the envelopes pass by the milling cutter. The cutter 72 protrudes through an opening 76 in the back plate 12 of the device and mills the edge of an envelope. Specifically, each tooth of the cutter cuts away segments of an edge of the envelope as the envelope is conveyed past the cutter to produce a feathered edge. As discussed further below, the back plate operates as a guide, guiding the edge of the envelope to be cut as it approaches the cutter assembly 70. Preferably a moveable outfeed guide 78 is provided for guiding the cut edge of the envelope as the cut edge is displaced away from the cutter assembly 70.

The edge of each envelope conveyed by the transport is justified against the back plate 12. Therefore, the depth of cut of the cutter into the envelope is determined by the distance that the cutter protrudes from the back plate 12. Since the device is operable to open a variety of types of envelopes, the depth of cut can be varied to correspond to the type of envelopes being processed in a particular stack. In the present instance, the depth of cut can be adjusted between 0.01" (0.03 cm) to 0.125" (0.32 cm). The depth of cut is controlled by an adjustment knob 75 on the control panel. Turning the knob one way pivots the cutter outwardly to increase the depth of cut. Turning the knob 75 in the opposite direction pivots the cutter inwardly to decrease the depth of cut.

As an envelope approaches the cutter 72, the transport 60 justifies the top edge of the envelope against the back plate 12. As the envelope passes by the cutter 72, the cutter cuts away a portion of the edge of the envelope, which creates a gap above the forward portion of the cut edge of the envelope as it is being cut. Since the transport 60 justifies the envelopes against the back plate as they are being cut, the leading edge of an envelope may skew inwardly toward the back plate as the envelope is being cut, so that the trailing portion of the cut edge may not be properly cut in some instances. Accordingly, preferably, the apparatus 10 includes a moveable outfeed guide 78 for guiding and supporting the leading portion of the cut edge of an envelope as the envelope is being cut. The outfeed guide 78 projects outwardly from the back plate 12 so that the outfeed guide supports the cut edge of the envelope as it is being cut. Preferably, the outfeed guide 78 projects outwardly from the back plate a distance substantially equal to the depth of cut of the cutter 72.

The device includes one or more sensors for detecting a characteristic of an envelope while the envelope is being cut. Based on the detected characteristic a controller controls the operation of the gate 80 to direct the envelope toward either the output conveyor 80 or the discharge slot 100. In the present instance, the device includes a thickness detector 40, a height detector 50 and a length detector.

Figure 4:
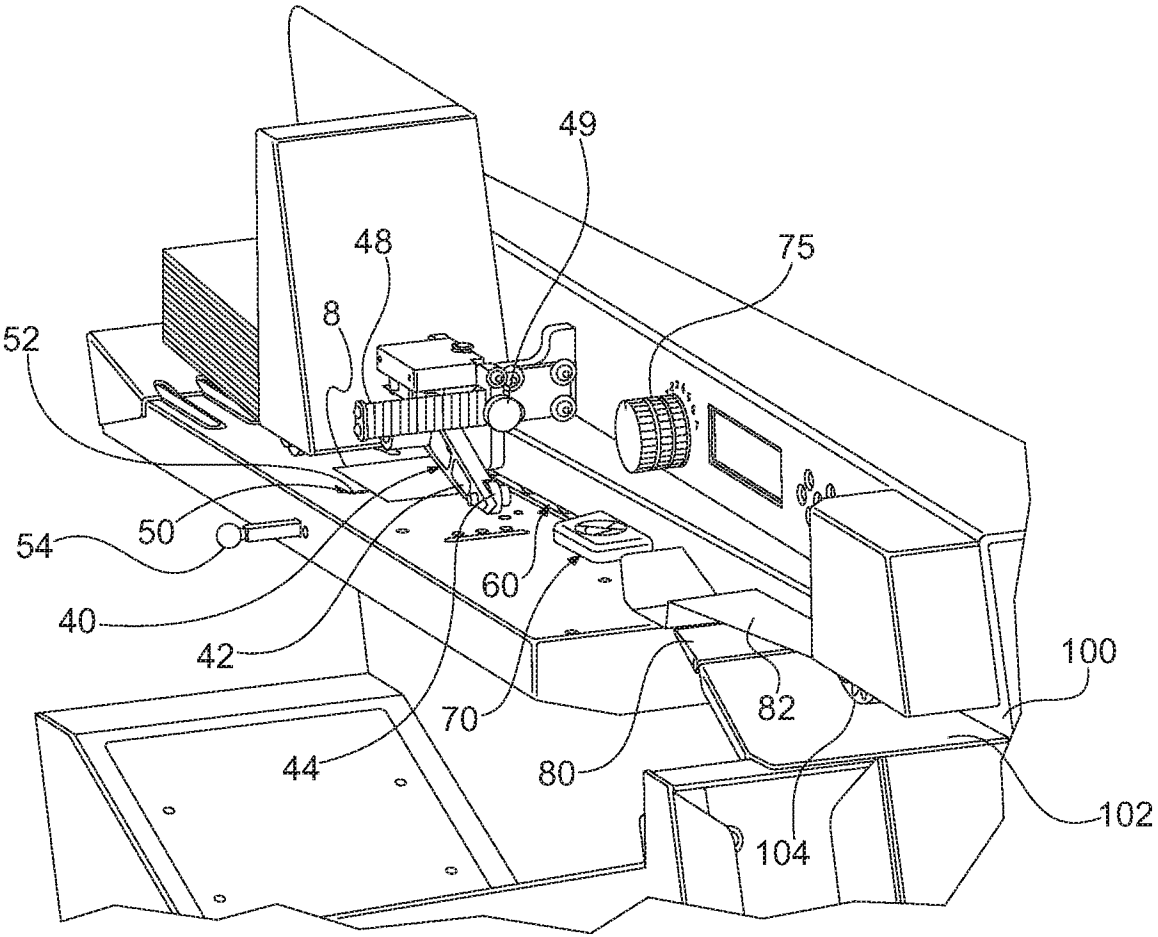
FIG. 4 is an enlarged fragmentary perspective broken away view, illustrating details of a cutter assembly of the apparatus illustrated in FIG. 1.

The thickness detector 40 may be any of numerous known detectors for measuring the thickness of a piece of mail while it is conveyed along an envelope path. Referring to FIGS. 3-4, in the present instance, the thickness detector comprises a roller 44 mounted on a pivotable arm 42. A biasing element biases the arm 42 downwardly to bias the roller toward the base plate 22. A sensor detects the displacement of the arm 42, to thereby determine the thickness of an envelope as the envelope passes between the roller 44 and the base plate.

In some applications. It is desirable to measure the thickness of a piece at a certain spot along the height of the envelope. For instance, it may be desirable to measure the thickness along a point that aligns with the window in windowed envelopes. In other instances it may be desirable to ensure that the thickness is not measured along a point that aligns with the window in windowed envelopes. Additionally, since the height of the mail may vary, the desired measuring point may also vary for each job. Accordingly, the thickness detector 40 may be mounted so that the roller may be adjusted across the width of the base plate. (Since the envelope is laying flat as it goes through the thickness detector 40, the height of the envelope is determined relative to the width of the base plate 22.)

In the present instance, the thickness detector 40 is mounted on a rail 48 that projects across the width of the envelope path, above the base plate 22. The thickness detector can be manually re-positioned across the width of the base plate by moving the thickness detector along the rail. A locking knob 49 locks the thickness detector in place along the rail so that the thickness detector remains in a fixed location along the length of the rail while processing a job.

The thickness detector 40 engages each envelope 8 at a point along the height of the envelope as the envelope transport 60 conveys the envelope past the thickness detector. In this way, the thickness detector 40 is operable to measure the thickness of the envelope at a plurality of points along the length of the envelope. In certain applications, this data may be used to analyze the thickness profile of the envelope. If the thickness profile of an envelope is analyzed, the controller may control the gate 80 in response to characteristics of the thickness profile.

In the present instance, the thickness detector 40 is positioned so that for most envelopes the thickness detector engages a portion of an envelope while the cutter 70 cuts the envelope. For instance, as the cutter begins to cut the edge of the envelope near the leading end of the envelope, the thickness detector may engage the envelope near the trailing end of the envelope. However, for exceptionally short pieces of mail, the trailing edge of the envelope may exit the thickness detector before the leading edge of the envelope enter the cutter assembly 70.

Referring to FIGS. 2-3, the height detector 50 is positioned along the envelope path so that the height of each piece is detected. The sensor for detecting the height of the envelopes may be any of a variety of detectors. In the present instance, the height detector 50 is positioned adjacent the thickness detector 40. A series of apertures 53 in the base plate 22 provides openings for a sensor 52. The apertures 53 are aligned across the width of the base plate 22. The sensor 52 is moveable across the width of the base plate 22 so that the sensor can be aligned with any of the apertures. An adjustment rod 54 is provided for adjusting the sensor 52. The sensor 52 is attached to the adjustment rod 54 so that pushing the rod inwardly moves the sensor inwardly toward the back plate 12, whereas pulling the rod outwardly moves the sensor outwardly toward the front of the device 10. The adjustment rod 49 may have a locating element, such as a series of ridges or depressions that cooperate with a mating element to operate as stops to align the rod with the apertures.

When the sensor 52 is aligned with an aperture, the sensor detects whether an envelope covers the aperture (and sensor) as the envelope transport 60 conveys the envelope from the input bin 20 to the cutter 70. In this way, the sensor 52 detects whether the height of an envelope is above or below a pre-determined threshold. Specifically, if an envelope does not cover the sensor as it is conveyed to the cutter, then the envelope has a height that is less than the distance from the back plate 12 to the sensor. If the envelope covers the sensor, then the envelope has a height at least as tall as the distance from the back plate 12 to the sensor.

The device may also include a printer assembly 65 for printing information on the envelopes. For instance, the printer may print a batch number, sequence number or other identifying information on the envelope as the envelope is conveyed through the device. In the present instance, the printer assembly 65 includes an ink jet printer 66 mounted above the base plate 22 by a mounting bracket 67. The printer 66 is mounted above the base plate to form a gap at least as large as the thickest envelope that is to be processed. The mounting bracket 67 may be configured to allow the print head 66 to be adjusted for each job depending on the thickness of the envelope being printed. However, in the present instance, the mounting bracket 67 is fixed so that the print head 66 is at a fixed position. Therefore, the gap between the print head and the base plate is a pre-defined thickness.

When using an ink jet printer, it is desirable to have the envelope as close to the printer as possible. However, the device is operable to process envelopes having a wide variety of thicknesses. Accordingly, in the present instance, the device 10 includes a deflector 68 for deflecting the envelopes upwardly toward the print head 66. The deflector 68 is a resiliently deformable element that projects upwardly from the base plate 22. For instance, as shown in FIG. 3, the deflector forms a ramp, angling upwardly from the base plate 22. The forward end of the deflector 68 bends downwardly to contact the base plate, thereby supporting the forward end of the deflector. The deflector 68 is resiliently deformable so that the deflector can collapse to accommodate thick envelopes. Configured in the way, the deflector 68 urges the lower edge of the envelope upwardly toward the printer head 66 while the upper edge of the envelope is nipped by the envelope transport 60.

A plurality of sensors detect the position of the envelopes as the envelopes proceed through the device 10. One or more of the sensors can be used to detect the length of an envelope as the envelope is conveyed. Although any of a variety of types of sensors can be used, in the present instance, the sensors comprise infrared sensors which each include an I/R emitter and an I/R receiver. Referring to FIG. 5, a plurality of sensors 96*a*, 96*b*, 96*c* are positioned along the envelope path between the input bin and the gate 80. The sensors 96*a,b,c* are operable to detect the leading edge and the trailing edge of an envelope as the envelope is conveyed. Since the speed of the envelope transport is known, the controller determines the time between detecting the leading edge and the trailing edge of an envelope, and the length of the envelope is determined based on such time and the transport speed.

After the envelopes are cut, the transport 60 conveys the envelopes toward the gate 80. The gate 80 is operable between an upper position and a lower position. In the lower position, the gate 80 directs the envelope upwardly toward the discharge slot 100 at the right end of the device. In the upper position, the gate 80 directs the envelope downwardly toward the return conveyor 90. The gate 80 may be controlled by any of a variety of actuators. For instance, a solenoid may pivot the gate between the upper and lower positions. The controller controls the operation of the gate actuator in response to signals received regarding one or more characteristics of the envelopes. For instance, if envelopes having a thickness above a threshold are to be outsorted, the controller controls the gate so that the gate is in the lower position in response to the thickness detector 40 detecting an envelope having a thickness above the thickness threshold. Similarly, the controller can control the gate 80 in response to the height of the envelope, the length of the envelope or any of a variety of combinations of the height, length or thickness of an envelope as detected by the device.

The device 10 may include a discharge guide 82 for guiding the envelopes after they exit the cutter. The discharge guide 82 is a rigid guide that prevents the envelopes from displacing upwardly out of the envelope path when the envelope transport 60 releases the envelope. The leading edge of the discharge guide 82 overlies the base plate 22 to form a slot between the guide and the base plate, The envelope enters the slot as it is conveyed away from the cutter 70. The guide is formed with a bend so that the lower edge of the guide is below the leading edge of the gate when the gate is in the upper position. In this way, if the gate is in the upper position, the guide directs the envelope below the gate to prevent the envelope from inadvertently catching on the gate and possibly deflecting upwardly toward the discharge slot 100 rather than the lower conveyor 90. Additionally, the discharge guide is formed so that the lower edge of the guide is above the leading edge of the gate when the gate is in the lower position. In this way, the guide does not prevent the envelope from engaging the gate 80 in the lower position so that the gate can deflect the envelope upwardly toward the discharge slot 100.

As discussed, when the gate 80 is in the upper position, the envelope is directed downwardly toward the lower conveyor, referred to as the output conveyor 90. As shown in FIG. 1, the transport 60 and the output conveyor 90 vertically overlap. The base plate 22 of the transport 60 terminates intermediate the output conveyor, so that a gap is provided between the end of the transport 60 and the right-most end of the conveyor 90. The discharge gap width is wider than the length of the longest envelope to be sorted to the output conveyor 90. In this way, envelopes directed toward the output conveyor exit the transport 60 and fall vertically onto the output conveyor.

The output conveyor 90 comprises a conveyor belt having a width that is wide enough to support and convey the envelopes. In the present instance, the output conveyor is generally horizontal. The conveyor 90 is disposed between a right end wall 94 that protrudes upwardly and a left end wall 96 adjacent the end of the output conveyor. The right end wall 94 operates as a stop, stopping the forward motion of the envelopes as they are discharged from the transport 60. Specifically, as an envelope is discharged from the transport 60, the envelopes is moving downwardly and forwardly from left to right from the perspective of FIGS. 1-2. After the envelope passes the gate 80 and falls to the output conveyor, the forward motion of the envelope continues to propel the envelope to the right. The right end wall 94 limits the forward motion of the envelope, preventing the envelope from being propelled off the end of the output conveyor.

The envelopes are discharged onto the output conveyor 90 so that a face of each envelope lies on the output conveyor. The output conveyor 90 conveys the envelopes toward the left end wall 96 that is at an angle to the output conveyor. As the leading edge of the first envelope on the output conveyor contacts the left wall 96, the output conveyor 90 drives the envelope up the left wall, thereby reorienting the envelope from a generally horizontal orientation to an inclined orientation. The output conveyor then conveys the next succeeding envelope into contact with the first envelope so that the envelope is driven up a face of the first envelope until the envelope is oriented similarly to the first envelope. In this way, the processed envelopes form a generally horizontal stack of envelopes resting on edge on the output conveyor. The stacked envelopes are then manually removed by an operator.

When the gate 80 is in the lower position, the gate directs the envelope toward the discharge slot 100. The transport 60 drives the envelope over the gate 80 and onto a generally horizontal ledge 102 adjacent the discharge slot. The ledge 102 projects from the back plate 12 and overlies the lower conveyor 90 to support the envelope as the envelope is conveyed to the discharge slot 100. A drive roller 104 positioned above the ledge 102 is biased toward the ledge. The drive roller 104 is vertically displaceable, similar to the rollers 62 of the envelope transport so that the drive roller can accommodate envelopes of various thicknesses. The drive roller 104 is operable to receive the envelope and drive the envelope through the discharge slot 100.

An output bin may be positioned adjacent the discharge slot 100 to receive envelopes that are discharged through the discharge slot. Alternatively, a discharge conveyor 110 can be positioned adjacent the discharge slot to receive envelopes. For instance, referring to FIG. 1, the discharge conveyor 110 may include a generally horizontal conveyor similar to the lower conveyor 90 described above. The discharge conveyor may be mounted on a frame having roller so that the discharge conveyor can be moved into position to be used with the device 10 or moved away when not needed.

The discharge conveyor includes an end wall 114 configured similarly to the end wall 96 of the lower conveyor 90 to reorient the envelopes from generally horizontal to generally vertical. Additionally, the discharge conveyor may include a side wall 116 operating as a stop to prevent envelope from falling off the side of the conveyor, particularly when the envelope is conveyed from the discharge slot 100 to the discharge conveyor. The device 10 may also include a discharge guide 112 for guiding the envelopes as the envelopes are conveyed through the discharge slot.

It will be recognized by those skilled in the art that changes or modifications may be made without departing from the broad inventive concepts of the invention.

The invention claimed is:

1. An apparatus for opening envelopes, comprising:

an input bin for receiving a stack of envelopes;

a transport for conveying the envelopes along an envelope path;

a sensor for detecting the height of an envelope while the transport conveys the envelope in a face down orientation a cutter positioned along the envelope path operable to sever an edge of the envelope wherein the cutter is positioned adjacent the sensor so that the cutter cuts the envelope while the sensor detects the height of the envelope;

a gate moveable between a first position and a second position to direct the envelope toward a first area or a second area after the cutter severs an edge of the envelope;

a controller operable to control the gate in response to the height of the envelope detected by the sensor.

2. The apparatus of claim 1 comprising a printer operable to print on the envelopes as the envelopes are conveyed.

3. The apparatus of claim 2 wherein the printer is positioned at a predetermined height and the apparatus comprises a deflector for deflecting the envelopes upwardly toward the printer.

4. The apparatus of claim 3 wherein the deflector is resiliently deformable to deflect envelopes of various thicknesses.

5. The apparatus of claim 1 comprising a thickness detector for detecting the thickness of the envelope, wherein the controller is operable to control the gate in response to both the height of the envelope detected by the sensor and the thickness of the envelope detected by the thickness detector.

6. The apparatus of claim 1 wherein the first area is a first conveyor and the second area is a second conveyor, wherein the first conveyor is underneath the transport and a gap is formed adjacent a distal end of the transport such that when the gate is in the first position the envelope passes through the gap and onto the first conveyor.

7. The apparatus of claim 6 wherein when the gate is in the first position the envelope falls through the gap and onto the first conveyor.

8. An apparatus for opening envelopes, comprising:

a transport for conveying a batch of envelopes along an envelope path, wherein the transport comprises a base;

a cutter positioned along the envelope path operable to sever an edge of an envelope;

a printer operable to print on the envelope as the transport conveys the envelope along the envelope path in a face down orientation, wherein the printer is spaced from the base to create a gap; and a deflector positioned on the base in the gap to deflect the envelope upwardly toward the printer, wherein the deflector comprises a resiliently deformable leg so that the deflector partially collapses when the envelope is conveyed over the deflector.

9. The apparatus of claim 8 wherein the deflector is resiliently deformable to deflect envelopes of various thicknesses.

10. The apparatus of claim 8 wherein the deflector comprises a resiliently deformable leg so that the deflector partially collapses when the envelope is conveyed over the deflector.

11. The apparatus of claim 10 wherein the transport nips a first portion of the envelope and the deflector deflects a second portion of the envelope while the first portion is nipped by the transport.

12. The apparatus of claim 8 wherein the deflector forms a ramp angling upwardly from the base toward the printer.

* * * * *